US009196183B2

(12) United States Patent
Hwang

(10) Patent No.: US 9,196,183 B2
(45) Date of Patent: Nov. 24, 2015

(54) DISPLAY DEVICE FOR HIGH-SPEED DATA TRANSMISSION AND METHOD OF DRIVING THE SAME

(71) Applicant: SAMSUNG DISPLAY CO., LTD., Yongin, Gyeonggi-Do (KR)

(72) Inventor: Moon-Sang Hwang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 53 days.

(21) Appl. No.: 14/100,607

(22) Filed: Dec. 9, 2013

(65) Prior Publication Data

US 2015/0002488 A1 Jan. 1, 2015

(30) Foreign Application Priority Data

Jun. 26, 2013 (KR) ..... 10-2013-0073943

(51) Int. Cl.
*G09G 3/00* (2006.01)

(52) U.S. Cl.
CPC ..... *G09G 3/00* (2013.01)

(58) Field of Classification Search
CPC ..... G09G 2330/06; G09G 3/3611
See application file for complete search history.

(56) References Cited

U.S. PATENT DOCUMENTS

| | | | | |
|---|---|---|---|---|
| 8,102,904 | B2 | 1/2012 | Mejia | |
| 2010/0110058 | A1* | 5/2010 | Moh et al. | 345/211 |
| 2010/0231787 | A1* | 9/2010 | Kim et al. | 348/503 |
| 2011/0080382 | A1* | 4/2011 | Koo | 345/204 |
| 2012/0056870 | A1* | 3/2012 | Koh | 345/215 |

FOREIGN PATENT DOCUMENTS

| | | |
|---|---|---|
| JP | 2007-129735 | 5/2007 |
| KR | 1020010072576 | 7/2001 |

* cited by examiner

*Primary Examiner* — Gerald Johnson
(74) *Attorney, Agent, or Firm* — F. Chau & Associates, LLC

(57) ABSTRACT

A display device is provided. The display device includes: a timing controller and a data driver. The timing controller is configured to receive input data, a main clock signal, a synchronization signal, or a protocol signal, to generate an internal clock signal by using the main clock signal, to convert the input data into image data, and to transmit the synchronization signal or the protocol signal using the internal clock signal. The data driver is configured to recover the synchronization signal or the protocol signal from the internal clock signal, and to drive the image data by using the recovered synchronization signal or the protocol signal.

16 Claims, 13 Drawing Sheets

FIG. 6

MAPT

| DE | 1 | 0 |
|---|---|---|
| Pulse width | 5UI | 9UI |

DISPLAY DEVICE FOR HIGH-SPEED DATA TRANSMISSION AND METHOD OF DRIVING THE SAME

CROSS-REFERENCE TO RELATED APPLICATION

This application claims priority under 35 U.S.C. §119 to Korean Patent Application No. 10-2013-0073943, filed on Jun. 26, 2013, in the Korean Intellectual Property Office, the disclosure of which is incorporated by reference herein in its entirety.

TECHNICAL FIELD

The present invention relates to a display device and a driving method thereof. More particularly, the present invention relates to a display device for transmitting data at a high rate.

DISCUSSION OF THE RELATED ART

A display device using digital data to display images may include a liquid crystal display (LCD), a plasma display panel (PDP), and an organic light emitting display (OLED). As a resolution or a size of the display device increases, a data transmission volume and a data transmission rate have been increased.

For example, the display device transmits a data signal to a data driving integrated circuit (IC) from a timing control IC, and it uses a synchronization signal and a protocol signal for controlling the data driving IC as well as the data signal. The synchronization signal may minimize an amount of memory used in the data driving IC or the timing control IC and may synchronize a drive timing of the display panel. The protocol signal may control an offset information of the data driving IC.

The timing control IC may use a low voltage differential signal (LVDS) interface or a transistor transistor logic (TTL) interface to transmit the synchronization signal or the protocol signal.

FIG. 1 shows a data mapping structure in a 6-bit LVDS transmission method.

Referring to FIG. 1, 6-bit red data (R0-R5), green data (G0-G5), and blue data (B0-B5) are transmitted through a plurality of transmission channels (CH1-CH3). The synchronization signal (e.g., data enable signal (DE)) or the protocol signal is transmitted through the transmission channel CH3 together with data. A clock signal (CLK) for recovering the red, green, and blue data (R0-R5, G0-G5, and B0-B5) is transmitted through an additional transmission channel.

When the 6-bit red, green, and blue data (R0-R5, G0-G5, B0-B5) are transmitted, 4 bits may be added in a blank period in which data bits are not transmitted, and thus 22 bits may be transmitted. The use of 4 bits in the blank period to transmit 22 bits may correspond to 22% of overhead for data transmission which is inefficient in the viewpoint of channel bandwidth.

The data overhead has an influence in realizing a circuit for high-speed data transmission. When there is a large amount of overhead in the case of transmitting the same data, a difference between data transmission rates is generated. For example, as shown in FIG. 2A, when the overhead used is 17%, the data transmission rate is 3.3 Gbps and a data eye W1 of a differential data signal becomes small. Referring to FIG. 2B, however, when the overhead used is 3%, the data transmission rate is 2.9 Gbps and a data eye W2 of the differential data signal becomes large.

FIG. 3 shows a data mapping structure according to a display port transmission method.

Referring to FIG. 3, a data signal is configured in a multi-stream transport packet (MTP) form. Additional information for a link operation is included in an MTP header or a virtual container (VC) payload and is then transmitted. A display port transmission method does not use a channel for transmitting clock signals for recovering data, but it uses a clock and data recovery (CDR) circuit for directly recovering the clock signal from data.

FIG. 4 shows a data mapping structure according to a reduced swing differential signaling (RSDS) transmission method.

Referring to FIG. 4, the RSDS transmission method uses different transmission lines to transmit the clock signal (CLK) and the data signal (Data). The RSDS transmission method transmits a control signal (e.g., start position (SP)) separately from the clock signal and data signal through a TTL pin. The transmission method such as RSDS may not increase the data transmission rate as the control signal is transmitted over a separate channel from the data transmission line. However, the cost of the timing control IC may be increased when the number of data pins or pads is increased. Further, the cost of a data driving IC may be increased when the number of signal wires is increased in a chip on flexible printed circuit (COF).

SUMMARY

An exemplary embodiment of the present invention provides a display device for transmitting a synchronization signal and a protocol signal in addition to image data without deterioration of data transmission rate deterioration or using an additional transmission channel.

According to an exemplary embodiment of the present invention provides a display device is provided. The display device includes a timing controller and a data driver. The timing controller is configured to receive input data, a main clock signal, a synchronization signal, or a protocol signal, to generate an internal clock signal by using the main clock signal, and to convert the input data into image data, and to transmit the synchronization signal or the protocol signal using the internal clock signal.

The data driver is configured to recover the synchronization signal or the protocol signal from the internal clock signal, and to drive the image data by using the recovered synchronization signal or the protocol signal.

The timing controller may be configured to transmit the image data to the data driver in synchronization with a rising edge of the internal clock signal for each period of the internal clock signal.

The timing controller may be configured to generate a blank data signal and a blank clock signal during a horizontal blank period and a vertical blank period, and to arrange the blank data signal to correspond to a rising edge of the blank clock signal.

The timing controller may be configured to generate the blank data signal by inverting the image data received before the horizontal blank period and the vertical blank period.

The timing controller may be configured to transmit the synchronization signal or the protocol signal by controlling the pulse width of the internal clock signal according to the synchronization signal or the protocol signal.

The timing controller may include a mapping table to map at least one data bit of the synchronization signal or the protocol signal and the pulse width of the internal clock signal.

The data driver may include a clock signal sampler configured to generate a plurality of sampling clock signals in synchronization with a rising edge of the internal clock signal, a clock and data recovery unit configured to recover the image data according to the sampling clock signals, and a decoder configured to extract the synchronization signal or the protocol signal from the mapping table, and to recover the synchronization signal or the protocol signal according to the pulse width of the internal clock signal.

The data driver may include a plurality of sub-data drivers configured to receive the internal clock signal.

The timing controller may be configured to control the pulse width of the internal clock signal at a first period of the internal clock signal according to a first data bit of the synchronization signal or a first data bit of the protocol signal, and to control the pulse width of the internal clock signal at a second period of the internal clock signal according to a second data bit of the synchronization signal or a second data bit of the protocol signal.

The timing controller may be configured to control the pulse width of the internal clock signal to be shorter than a reference pulse width, to be longer than the reference pulse width, or to be substantially equal to the reference pulse width.

According to an embodiment of the present invention provides a method for driving a display device is provided. The method includes converting input data into image data, generating an internal clock signal with a pulse width that corresponds to a synchronization signal or a protocol signal, recovering the synchronization signal or the protocol signal from the internal clock signal, and converting the image data into a plurality of data signals according to the recovered synchronization signal or the protocol signal.

The generating of an internal clock signal may include using a mapping table to map at least one data bit of the synchronization signal or at least one data bit of the protocol signal and a pulse width of the internal clock signal.

The generating of an internal clock signal may include controlling the pulse width of the internal clock signal at a first period of the internal clock signal according to a first bit of the synchronization signal or a second bit of the protocol signal, and controlling the pulse width of the internal clock signal at a second period of the internal clock signal according to a second data bit of the synchronization signal or a second data bit of the protocol signal.

The controlling of a pulse width of the internal clock signal may include controlling the pulse width of the internal clock signal to be shorter than a reference pulse width, to be longer than the reference pulse width, or to be substantially equal to the reference pulse width.

The method may further include generating a blank data signal and a blank clock signal during a horizontal blank period and a vertical blank period, and arranging the blank data signal to correspond to a rising edge of the blank clock signal.

The method may further include generating the blank data signal by inverting the image data received before the horizontal blank period and the vertical blank period.

The converting into a plurality of data signals may include generating a plurality of sampling clock signals in synchronization with a rising edge of the internal clock signal, recovering the image data according to the sampling clock signals, and extracting the synchronization signal or the protocol signal from the mapping table that maps at least one data bit of the synchronization signal or at least one data bit of the protocol signal and the pulse width of the internal clock signal, and recovering the synchronization signal or the protocol signal according to the pulse width of the internal clock signal.

BRIEF DESCRIPTION OF THE DRAWINGS

Exemplary embodiments of the invention will become more apparent by describing in detail exemplary embodiments thereof with reference to the accompanying drawings in which:

FIG. 6 shows a mapping table (MAPT) according to an exemplary embodiment of the present invention;

DETAILED DESCRIPTION OF THE EMBODIMENTS

Figure 1:
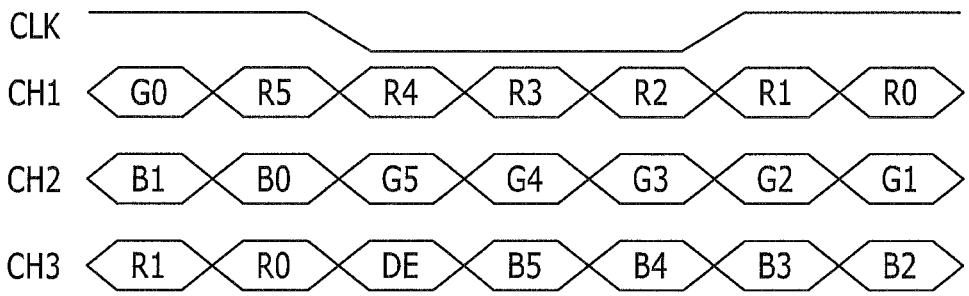
FIG. 1 shows a data mapping structure in a 6-bit a low voltage differential signal (LVDS) transmission method.
Figure 2A:
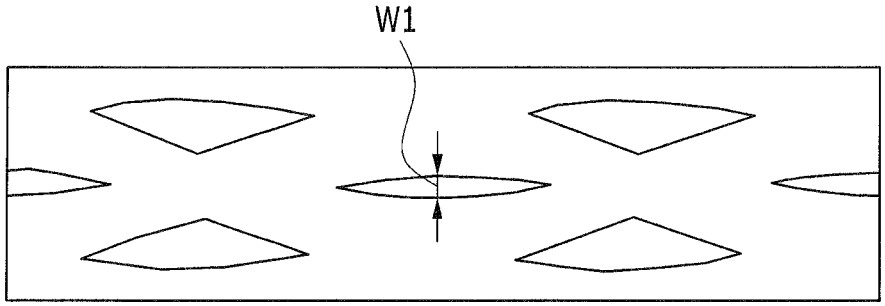
FIG. 2A shows an eye diagram of a differential data signal.
Figure 2B:
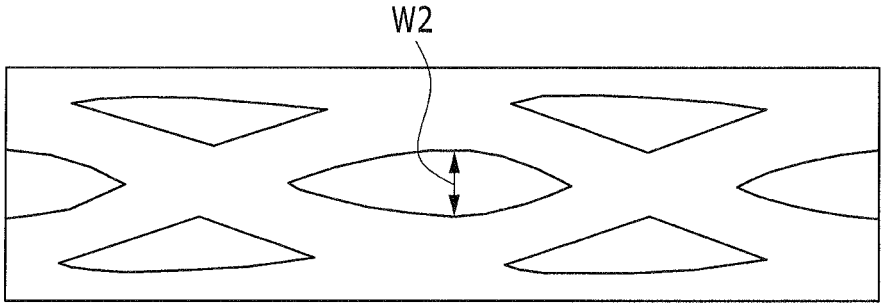
FIG. 2B shows an eye diagram of another differential data signal.
Figure 3:
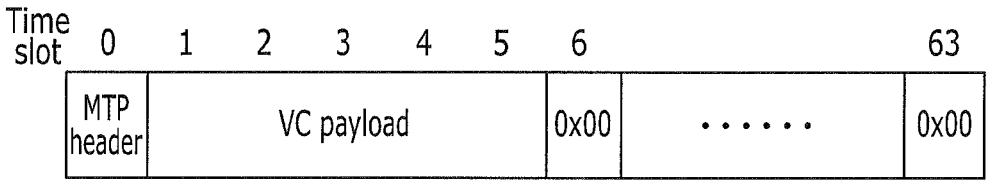
FIG. 3 shows a data mapping structure according to a display port transmission method.
Figure 4:
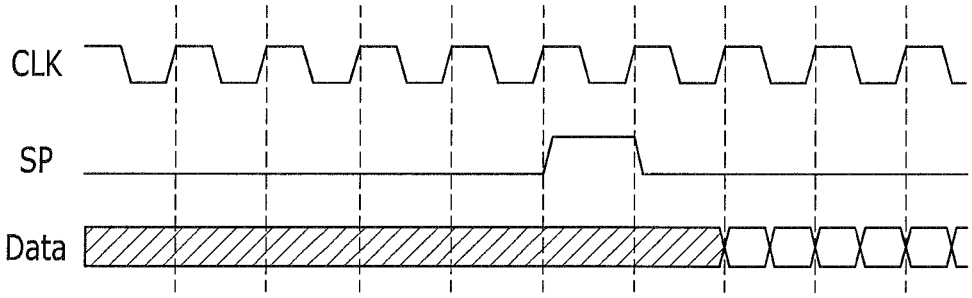
FIG. 4 shows a data mapping structure according to a reduced swing differential signaling (RSDS) transmission method.

Hereafter, exemplary embodiments of the present invention will be described in detail with reference to the accompanying drawing. The present invention may, however, be embodied in many different forms, and should not be construed as being limited to the embodiments set forth herein. Like reference numerals may designate like elements throughout the specification.

Figure 5:
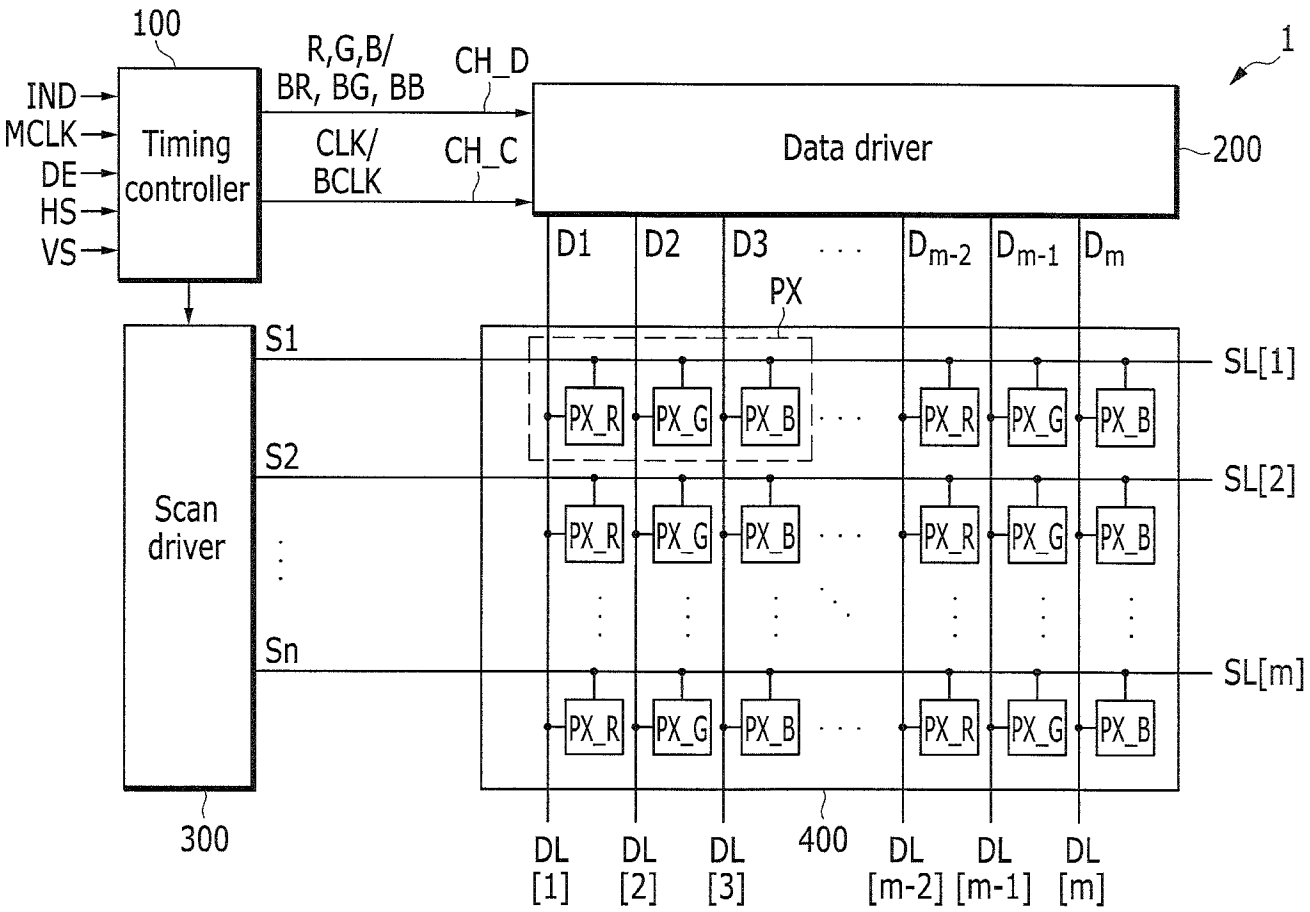
FIG. 5 shows a block diagram of a display device according to an exemplary embodiment of the present invention.

FIG. 5 shows a block diagram of a display device according to an exemplary embodiment of the present invention.

Referring to FIG. 5, the display device 1 may include a timing controller 100, a data driver 200, a scan driver 300, and a display 400.

The timing controller 100 may receive an input data signal (IND), a main clock signal (MCLK), a synchronization signal, and a protocol signal from an external device, and may process the input data signal (IND) according to characteristics of the display 400 to convert the input data (IND) into image data (R, G, and B). For example, the synchronization signal may include a data enable signal (DE), a horizontal synchronization signal (HS), or a vertical synchronization signal (VS). The protocol signal may be transmitted by a user to perform an operation such as controlling an offset of the data driver 200. The timing controller 100 may arrange the image data (R, G, and B) on each scan line and frame according to the horizontal synchronization signal (HS) and the vertical synchronization signal (VS), respectively.

The timing controller 100 may use the main clock signal (MCLK) to generate an internal clock signal (CLK), and may transmit the image data (R, G, and B) to the data driver 200 through a data transmission line (CH_D). The image data may be arranged in synchronization with a rising edge of the internal clock signal (CLK). The timing controller 100 may control a pulse width of the internal clock signal (CLK) according to the synchronization signal or the protocol signal. Timing controller 100 may transmit the controlled signal to the data driver 200 through a clock signal transmission line (CH_C).

One period of the internal clock signal (CLK) may be determined by the number of bits expressing the image data (R, G, and B) transmitted to a plurality of pixels (PX). For example, when 6-bit image data (R, G, and B) are transmitted to respective red, green, and blue subpixels (PX_R, PX_G, and PX_B), one period of the internal clock signal (CLK) may be 6 unit intervals (UI) which corresponds to the number of bits expressing 6-bit image data.

The timing controller 100 may transmit the image data (R, G, and B) to the driver 200 for each period of the internal clock signal (CLK). The rising edge of the internal clock signal (CLK) may include frequency information of the image data (R, G, and B). The timing controller 100 may use a falling edge of the internal clock signal (CLK) to transmit information that corresponds to the synchronization signal and the protocol signal to the data driver 200. For example, the timing controller 100 may use a stored mapping table (MAPT) to control a falling edge time of the internal clock signal (CLK). The mapping table (MAPT) may be stored in the timing controller 100 and/or the data driver 200. However, the location of the mapping table (MAPT) is not limited thereto.

The mapping table (MAPT), as shown in FIG. 6, may include information on a pulse width of the internal clock signal (CLK) that corresponds to the data enable signal (DE). For example, the information on the data enable signal (DE) may be expressed as a digital data bit such as "0" or "1", wherein a pulse width that corresponds to the "0" data bit may be defined as 5 UI and a pulse width that corresponds to the "1" data bit may be defined as 9 UI. However, the exemplary embodiment of the present invention is not restricted to the above description. For example, when there are a plurality of synchronization signals to be transmitted to the data driver 200, the number of data bits corresponding to the plurality of synchronization signals may be defined according to the number of the plurality of synchronization signals and the number of pulse widths may be defined by the number of the combinations among the respective data bits of the plurality of synchronization signals. For example, when there are n synchronization signals, the number of data bits to express the three synchronization signals may be n-bit and the number of pulse widths to be defined may be $2^n$. The protocol signal may be defined by at least 2 bits, and the pulse width may be defined by the number of cases of the corresponding protocol signal. For example, when one period of the internal clock signal (CLK) is a Tn time, information on (Tn−1)-numbered synchronization signals or protocol signals may be included.

Figure 7:
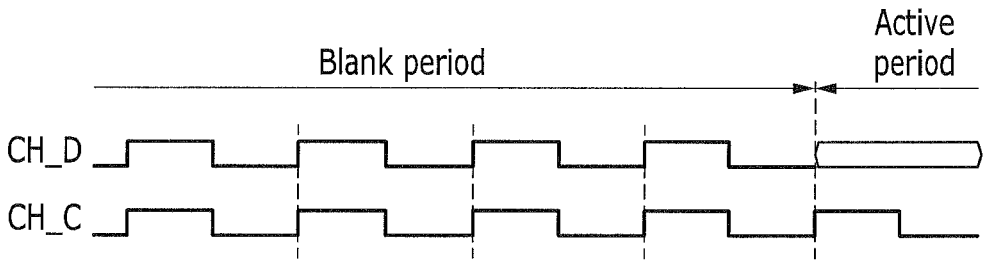
FIG. 7 shows a blank period according to an exemplary embodiment of the present invention.

The timing controller 100 may generate blank data signals (BR, BG, and BB) and a blank clock signal (BCLK) for a horizontal blank period and a vertical blank period, respectively, and may transmit the blank data signals (BR, BG, and BB) and the blank clock signal (BCLK) to the data driver 200 through the data transmission line (CH_D) and the clock signal transmission line (CH_C), respectively. For example, each of the horizontal blank period and the vertical blank period may represent a period in which the image data (R, G, and B) are expressed as a 255 grayscale level ($11111111_2$) or a 0 grayscale level ($00000000_2$). Each of the horizontal blank period and the vertical blank period may exist for each scan line and frame. Since the data bit is maintained at "1" or "0" during the blank period, the image data (R, G, and B) received after the horizontal blank period and the vertical blank period may not be synchronized with the internal clock signal (CLK). Therefore, as shown in FIG. 7, the timing controller 100 may invert the image data (R, G, and B) received before the horizontal blank period and the vertical blank period to generate blank data signals (BR, BG, and BB), and may match a rising edge of the blank data signals (BR, BG, and BB) with a rising edge of the blank clock signal (BCLK) to compensate a skew between the image data (R, G, and B) and the clock signal (CLK). The timing controller 100 may include a delay locked loop (DLL) circuit, a variable delay line (VDL) circuit, or a programmable delay line (PDL) circuit.

The data driver 200 may receive the image data (R, G, and B) and the internal clock signal (CLK), and may recover the synchronization signal and the protocol signal from the internal clock signal (CLK). The data driver 200 may sample the image data (R, G, and B) according to the recovered synchronization signal, and may latch the image data to generate a plurality of data signals (D1-Dm). The data driver 200 may reset an offset according to the recovered protocol signal.

The scan driver 300 may generate a plurality of scan signals (S1-Sn) and transmit the scan signals (S1-Sn) to corresponding scan lines (SL1-SLn). When the timing controller 100 transmits the synchronization signal or the protocol signal to the scan driver 300, the timing controller 100 may include information on the synchronization signal or the protocol signal in the falling edge of the internal clock signal (CLK) and transmit the synchronization signal or the protocol signal to the scan driver 300 with the same or similar manner as when the timing controller 100 transmits the synchronization signal or the protocol signal to the data driver 200.

The display 400 may be a display area including a plurality of pixels (PX). The display 400 may include a plurality of scan lines (SL1-SLn) for transmitting a plurality of scan signals (S1-Sn). The display 400 may include a plurality of data lines (DL1-DLm) for transmitting a plurality of data signals (D1-Dm). The display 400 may include a plurality of wires for applying a first driving voltage VDD and a second driving voltage (VSS). The pixels (PX) are respectively connected to the corresponding scan lines, the corresponding data line, a wire applying the first driving voltage VDD, and/or a wire applying the second driving voltage (VSS).

Figure 8:
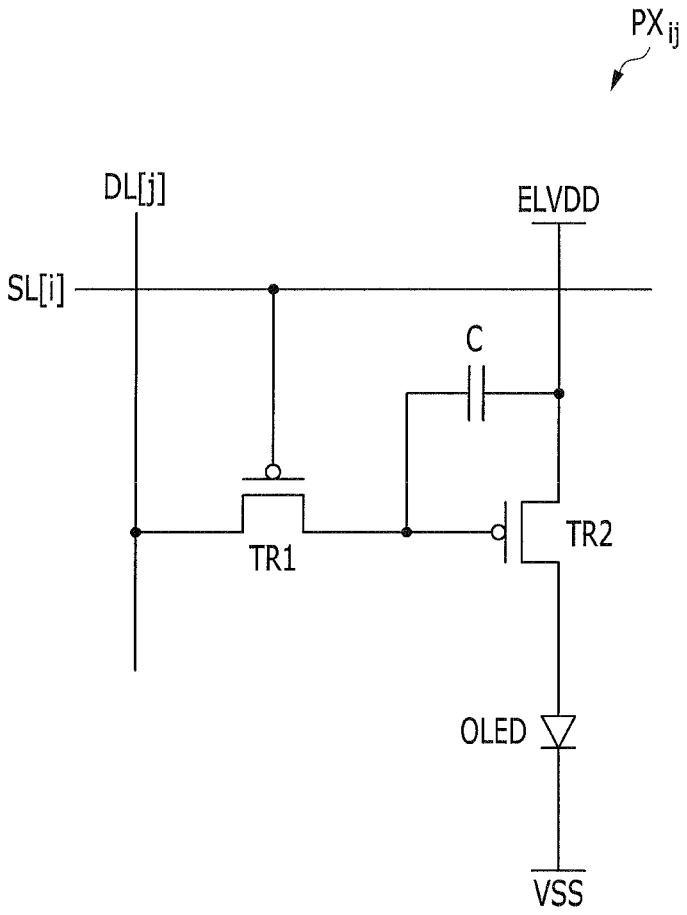
FIG. 8 shows an equivalent circuit of a pixel (PX) according to, an exemplary embodiment of the present invention.

For example, the pixels (PX) may include a red subpixel (PX_R) for emitting red light, a green subpixel (PX_G) for emitting green light, and a blue subpixel (PX_B) for emitting blue light. As shown in FIG. 8, the pixel (PXij) connected to the i-th scan line (SL[i]) and the j-th data line (DL[j]) may include a switching transistor (TR1), a driving transistor (TR2), a capacitor (C), and/or an organic light emitting diode (OLED).

The switching transistor (TR1) may include a gate electrode connected to the scan line (SL[i]), a source electrode connected to the data line (DL[j]), and a drain electrode connected to a gate electrode of the driving transistor (TR2).

The driving transistor (TR2) may include a source electrode connected to the wire applying the first driving voltage VDD, a drain electrode connected to an anode of the organic light emitting diode (OLED), and a gate electrode for receiving a voltage (Vdata) that corresponds to the data signal (D[j]) through the data line (DL[j]) when the switching transistor (TR1) is turned on.

The capacitor (C) may be connected between the gate electrode and the source electrode of the driving transistor (TR2). A cathode of the organic light emitting diode (OLED) may be connected to the wire applying the second driving voltage (VSS).

In the above-configured pixel (PXij), when the switching transistor (TR1) is turned on by the scan signal (Si), the data voltage (Vdata) may be transmitted to the gate electrode of the driving transistor (TR2). A voltage difference between the gate electrode and the source electrode of the driving transistor (TR2) may be maintained by the capacitor (C), and a driving current (Id) may flow to the driving transistor (TR2). The organic light emitting diode (OLED) may emit light according to the driving current (Id). However, the exemplary embodiment of the present invention is not restricted to the above description. The pixel (PXij) shown in FIG. 8 represents an example of the pixel of the display device, and other types of pixels are usable. Further, the display device according to the exemplary embodiment of the present invention may be applicable to various types of display devices such as liquid crystal display (LCD) or a plasma display panel (PDP).

Figure 9:
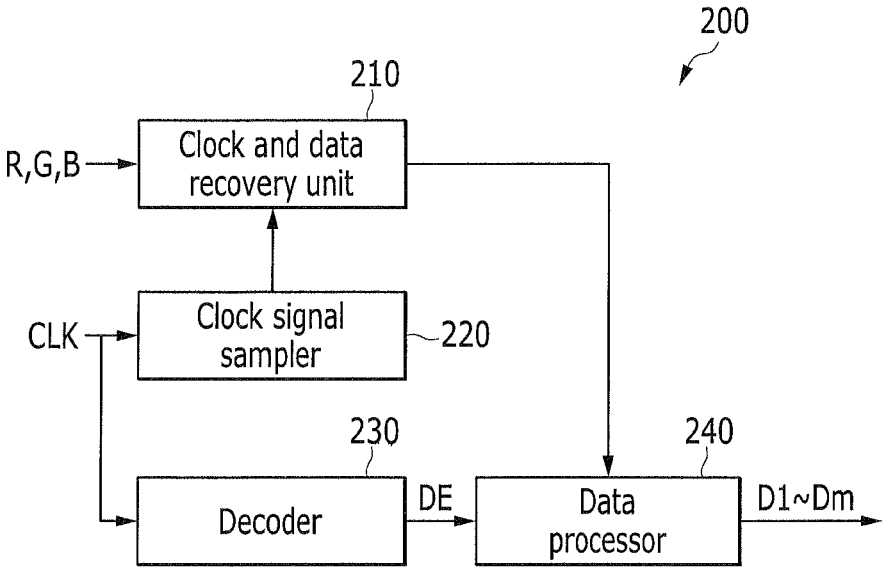
FIG. 9 shows a block diagram of a data driver shown in FIG. 5, according to an exemplary embodiment of the present invention.

FIG. 9 shows a block diagram of the data driver 200 shown in FIG. 5, according to an exemplary embodiment of the present invention.

Referring to FIG. 9, the data driver 200 may include a clock and data recovery (CDR) unit 210, a clock signal sampler 220, a decoder 230, and a data processor 240. The clock and data recovery unit 210 may recover the image data (R, G, and B) based on n sampling clock signals (SCLK).

The clock signal sampler 220 may generate n sampling clock signals (SCLK) in synchronization with the rising edge of the internal clock signal (CLK). For example, the clock signal sampler 220 may include a phase locked loop (PLL). The clock signal sampler 220 may generate a reference clock signal in synchronization with the rising edge of the internal clock signal (CLK), and may perform a phase interpolation process on the reference clock signal to generate n sampling clock signals (SCLK).

The decoder 230 may recover the data enable signal (DE) and the protocol signal from the mapping table (MAPT) based on a pulse width of the internal clock signal (CLK). The decoder 230 may detect the rising edge and the falling edge of the internal clock signal (CLK) to detect a portion (e.g., pulse width) of an active region of the internal clock signal (CLK). The decoder 230 may extract the data enable signal (DE) and the protocol signal that correspond to the detected pulse width of the internal clock signal (CLK).

The data processor 240 may generate the image data (R, G, and B) into a plurality of data signals (D1-Dm) according to the recovered data enable signal (DE). The data processor 240 may control the offset according to the recovered protocol signal.

Figure 10:
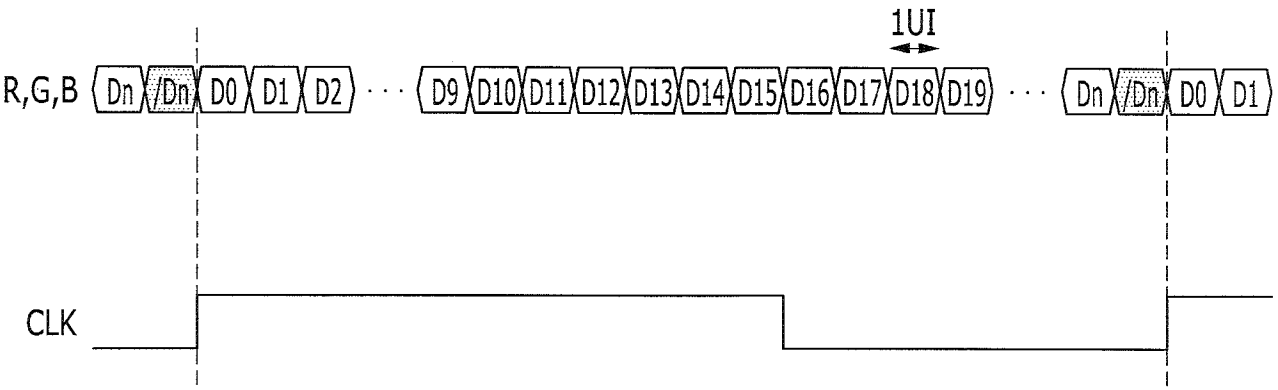
FIG. 10 shows a data mapping structure according to an exemplary embodiment of the present invention.

FIG. 10 shows a data mapping structure according to an exemplary embodiment of the present invention.

Referring to FIG. 10, the timing controller 100 may use the rising edge of the internal clock signal (CLK) to transmit frequency information of the image data (R, G, and B) to the data driver 200, and may use the falling edge of the internal clock signal (CLK) to transmit information on the data enable signal (DE) and the protocol signal to the data driver 200.

The exemplary embodiment of the present invention may improve the data transmission rate compared to a method for transmitting the synchronization signal or the protocol signal together with the image data (R, G, and B). According to the exemplary embodiment of the present invention, an additional transmission channel for transmitting the synchronization signal or the protocol signal may not be needed.

Figure 11:
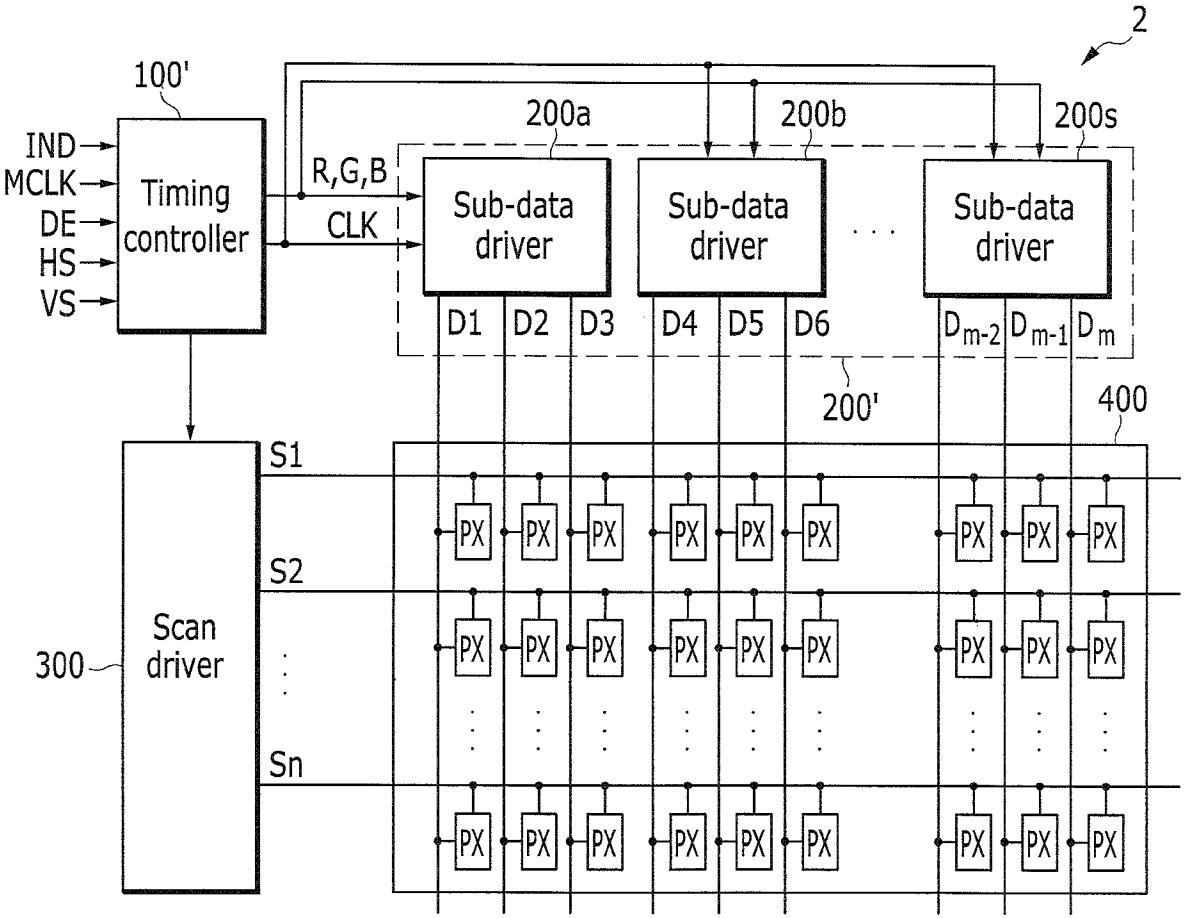
FIG. 11 shows a block diagram of a display device according to another exemplary embodiment of the present invention.

FIG. 11 shows a block diagram of a display device 2 according to an exemplary embodiment of the present invention.

Referring to FIG. 11, the display device 2 may include a timing controller 100', a data driver 200', a scan driver 300, and a display 400. The scan driver 300 and the display 400 correspond to the description provided with FIG. 5 and have the same reference numerals, and thus no detailed description will be provided.

The timing controller 100' may use a plurality of periods of the internal clock signal (CLK) to include information on a synchronization signal or a protocol signal. The timing controller 100 of FIG. 5 uses one period to include information on a synchronization signal or a protocol signal. For example, with the timing controller 100', when the protocol signal is expressed with 3-bit digital data of "001", information on the respective bits of the digital data may be included and transmitted for each period of the internal clock signal (CLK). With the timing controller 100, information on the 3-bit digital data is included in one period of the internal clock signal (CLK).

For example, the timing controller 100' may set a reference pulse width. The timing controller 100' may control a pulse width of the internal clock signal (CLK) to be shorter than the reference pulse width, to be longer than the reference pulse width, or substantially equal to the reference pulse width according to information on the respective bits of the digital data. For example, the reference pulse width may be a half width of the period (e.g., corresponding to a 50% duty ratio) of the internal clock signal (CLK). The timing controller 100' may control a pulse width of the internal clock signal (CLK) to be shorter (e.g., corresponding to less than a 50% duty ratio) than the half width of the period, to be longer (e.g., corresponding to larger than a 50% duty ratio) than the half width of the period, or substantially equal to the half width of the period according to information on the respective bits of the digital data. However, the reference pulse width is not limited thereto. For example, when one of the respective bits is "0," the pulse width of the internal clock signal (CLK) may be set to be shorter (e.g., corresponding to a less than a 50% duty ratio) than the reference pulse width. When one of the respective bits is "1," the pulse width of the internal clock signal (CLK) may be set to be longer (e.g., corresponding to larger than a 50% duty ratio) than the reference pulse width. When the protocol signal is not input, the pulse width of the internal clock signal (CLK) may be set to be the same as the reference pulse width (e.g., corresponding to a 50% duty ratio). The data driver 200' may include a plurality of sub-data drivers (200*a*-200*s*).

Figure 12:
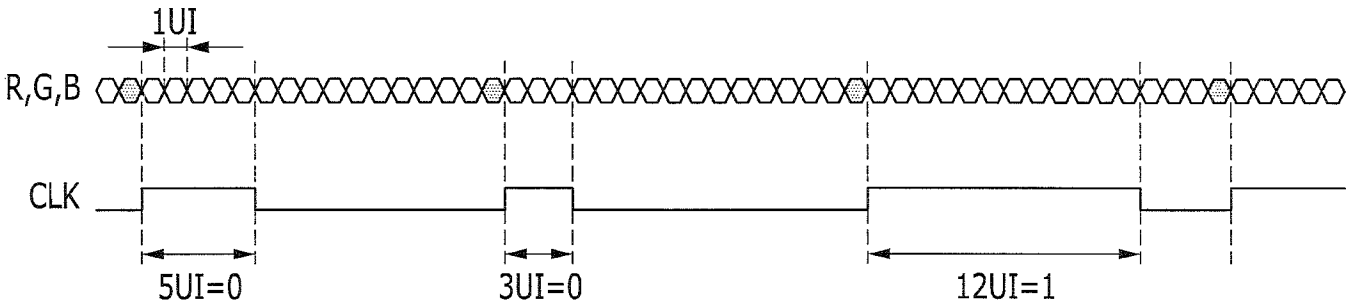
FIG. 12 shows a data mapping structure according to an exemplary embodiment of the present invention.

For example, as shown in FIG. 12, when one period of the internal clock signal (CLK) is 16 UI and the digital data that corresponds to the protocol signal is "001," the timing controller 100' may generate an internal clock signal (CLK) with a pulse width of 5 UI in the first period of the internal clock signal (CLK), an internal clock signal (CLK) with a pulse width of 3 UI in the second period, and an internal clock signal (CLK) with a pulse width of 12 UI in the third period.

When the pulse width of the internal clock signal (CLK) is set to be 1 UI to include information on the synchronization signal or the protocol signal, the internal clock signal (CLK) may be transmitted at the same high transmission rate as the image data (R, G, and B), and there may be a limitation in processing for the data driver 200' to recover the protocol signal or the synchronization signal. According to an embodiment of the present inventive concept, the timing controller 100' may include information on the synchronization signal or the protocol signal by controlling the pulse width of the internal clock signal (CLK) to be shorter or longer with reference to the reference pulse width, and may reduce the transmission rate of the internal clock signal (CLK). One internal clock signal (CLK) may be simultaneously transmitted by using the plurality of sub-data drivers (200*a*-200*s*) (e.g., the multi-drop method), to reduce the number of data pins or pads.

According to the exemplary embodiments of the present invention, the display device uses the pulse width modulation method of the clock signals to transmit the synchronization signal and the protocol signal as well as the image data without deterioration of data transmission or using an additional transmission channel. Hence, the data are transmitted at a high rate and a realization cost of an IC is reduced.

While this invention has been shown and described with reference to exemplary embodiments thereof, it will be understood by those ordinary skill in the art that various changes in form and details may be made therein without departing from the spirit and scope of the invention as defined by the following claims.

What is claimed is:

1. A display device comprising:

a timing controller configured to receive input data, a main clock signal, a synchronization signal, or a protocol signal, to generate an internal clock signal by using the main clock signal, and to convert the input data into image data, and to transmit the synchronization signal or the protocol signal using the internal clock signal; and a data driver configured to recover the synchronization signal or the protocol signal from the internal clock signal, and to drive the image data by using the recovered synchronization signal or the protocol signal, wherein the timing controller is configured to transmit the synchronization signal or the protocol signal by controlling a pulse width of the internal clock signal according to the synchronization signal or the protocol signal.

2. The display device of claim 1, wherein the timing controller is configured to transmit the image data to the data driver in synchronization with a rising edge of the internal clock signal for each period of the internal clock signal.

3. The display device of claim 1, wherein the timing controller includes a mapping table to map at least one data bit of the synchronization signal or at least one data bit of the protocol signal and the pulse width of the internal clock signal.

4. The display device of claim 3, wherein the data driver includes:

a clock signal sampler configured to generate a plurality of sampling clock signals in synchronization with a rising edge of the internal clock signal;

a clock and data recovery unit configured to recover the image data according to the sampling clock signals; and a decoder configured to extract the synchronization signal or the protocol signal from the mapping table, and to recover the synchronization signal or the protocol signal according to the pulse width of the internal clock signal.

5. The display device of claim 1, wherein the data driver includes a plurality of sub-data drivers configured to receive the internal clock signal.

6. The display device of claim 5, wherein the timing controller is configured to control the pulse width of the internal clock signal at a first period of the internal clock signal according to a first data bit of the synchronization signal or a first data bit of the protocol signal, and to control the pulse width of the internal clock signal at a second period of the internal clock signal according to a second data bit of the synchronization signal or a second data bit of the protocol signal.

7. The display device of claim 6, wherein the timing controller is configured to control the pulse width of the internal clock signal to be shorter than a reference pulse width, to be longer than the reference pulse width, or to be substantially equal to the reference pulse width.

8. A display device comprising:

a timing controller configured to receive input data, a main clock signal, a synchronization signal, or a protocol signal, to generate an internal clock signal by using the main clock signal, and to convert the input data into image data, and to transmit the synchronization signal or the protocol signal using the internal clock signal; and a data driver configured to recover the synchronization signal or the protocol signal from the internal clock signal, and to drive the image data by using the recovered synchronization signal or the protocol signal, wherein the timing controller is configured to transmit the image data to the data driver in synchronization with a rising edge of the internal clock signal for each period of the internal clock signal, wherein the timing controller is configured to generate a blank data signal and a blank clock signal during a horizontal blank period and a vertical blank period, and to arrange the blank data signal to correspond to a rising edge of the blank clock signal.

9. The display device of claim 8, wherein the timing controller is configured to generate the blank data signal by inverting the image data before the horizontal blank period and the vertical blank period.

10. A method for driving a display device, comprising:

converting input data into image data;

generating an internal clock signal, wherein a pulse width of the internal clock signal corresponds to a synchronization signal or a protocol signal;

recovering the synchronization signal or the protocol signal from the internal clock signal; and converting the image data into a plurality of data signals according to the recovered synchronization signal or the protocol signal.

11. The method of claim 10, wherein the generating of an internal clock signal includes using a mapping table to map at least one data bit of the synchronization signal or at least one data bit of the protocol signal and the pulse width of the internal clock signal.

12. The method of claim 10, wherein the generating of an internal clock signal includes controlling the pulse width of the internal clock signal at a first period of the internal clock signal according to a first bit of the synchronization signal or a second bit of the protocol signal, and controlling the pulse width of the internal clock signal at a second period of the internal clock signal according to a second data bit of the synchronization signal or a second data bit of the protocol signal.

13. The method of claim 12, wherein the controlling of the pulse width of the internal clock signal includes controlling the pulse width of the internal clock signal to be shorter than a reference pulse width, to be longer than the reference pulse width, or to be substantially equal to the reference pulse width.

14. The method of claim 10, further comprising generating a blank data signal and a blank clock signal during a horizontal blank period and a vertical blank period, and arranging the blank data signal to correspond to a rising edge of the blank clock signal.

15. The method of claim 14, further comprising generating the blank data signal by inverting the image data before the horizontal blank period and the vertical blank period.

16. The method of claim 10, wherein the converting the image data into a plurality of data signals includes:

generating a plurality of sampling clock signals in synchronization with a rising edge of the internal clock signal;

recovering the image data according to the sampling clock signals; and extracting the synchronization signal or the protocol signal from a mapping table that maps at least one data bit of the synchronization signal or at least one data bit of the protocol signal and the pulse width of the internal clock signal; and recovering the synchronization signal or the protocol signal according to the pulse width of the internal clock signal.

* * * * *